US008380498B2

(12) United States Patent
Gao

(10) Patent No.: US 8,380,498 B2
(45) Date of Patent: Feb. 19, 2013

(54) TEMPORAL ENVELOPE CODING OF ENERGY ATTACK SIGNAL BY USING ATTACK POINT LOCATION

(75) Inventor: Yang Gao, Mission Viejo, CA (US)

(73) Assignees: GH Innovation, Inc., Irvine, CA (US); Huawei Technologies Co., Ltd., Shenzhen (CN)

( * ) Notice: Subject to any disclaimer, the term of this patent is extended or adjusted under 35 U.S.C. 154(b) by 676 days.

(21) Appl. No.: 12/554,705

(22) Filed: Sep. 4, 2009

(65) Prior Publication Data

US 2010/0063811 A1 Mar. 11, 2010

Related U.S. Application Data

(60) Provisional application No. 61/094,886, filed on Sep. 6, 2008.

(51) Int. Cl.
*G10L 19/00* (2006.01)

(52) U.S. Cl. ..... 704/230

(58) Field of Classification Search ..... 704/207, 704/230

See application file for complete search history.

(56) References Cited

U.S. PATENT DOCUMENTS 6,424,939 B1 7/2002 Herre et al.
6,826,525 B2 11/2004 Hilpert et al.
7,020,615 B2 * 3/2006 Vafin et al. ..... 704/500
7,313,519 B2 * 12/2007 Crockett ..... 704/226
7,516,066 B2 4/2009 Schuijers et al.
7,930,184 B2 * 4/2011 Fejzo ..... 704/500
2002/0111798 A1 * 8/2002 Huang ..... 704/220
2009/0319261 A1 * 12/2009 Gupta et al. ..... 704/207

OTHER PUBLICATIONS

Vafin, R., et al., "Modifying Transients for Efficient Coding of Audio," IEEE International Conference on Acoustics, Speech, and Signal Processing, Proceedings ICASSP '01, May 7, 2001 to May 11, 2001, 4 pages, vol. 5, IEEE.
Jax, P., et al., "An Embedded Scalable Wideband Codec Based on the GSM EFR Codec," 2006, pp. I-5-I-8, IEEE.
International Telecommunications Union, ITU-T Telecommunication Standardization Sector of ITU, "Series G: Transmission Systems and Media, Digital Systems and Networks," ITU-T Recommendation G.729.1, May 2006, 100 pages.
Kövesi, B., et al., "Pre-Echo Reduction in the ITU-T G.729.1 Embedded Coder," Aug. 25, 2008, 5 pages.

* cited by examiner

*Primary Examiner* — Jakieda Jackson
(74) *Attorney, Agent, or Firm* — Slater & Matsil, L.L.P.

(57) ABSTRACT

A method of transceiving an audio signal is disclosed. An input audio signal is provided. It is determined whether an energy attack signal exists within the input audio signal and a decision flag is set if the energy attack signal exists. A temporal location of the energy attack point in the input audio signal is detected. Energy variations before and after the temporal location of an energy attack point are determined. The energy variations to produce quantized energy variations and a peak area energy of the input audio signal to produce a quantized peak area energy are quantized. The decision flag, the temporal location of the energy attack point, the quantized energy variations, and the quantized peak energy are transmitted.

19 Claims, 8 Drawing Sheets

TEMPORAL ENVELOPE CODING OF ENERGY ATTACK SIGNAL BY USING ATTACK POINT LOCATION

This patent application claims priority to U.S. Provisional Application No. 61/094,886, filed on Sep. 6, 2008, and entitled "Temporal Envelope Coding of Energy Attack Signal," which application is incorporated by reference herein.

TECHNICAL FIELD

This application is generally related to audio/speech coding, and particularly to low bit rate audio/speech coding.

BACKGROUND

If the bit rate for transform coding is very low, a concept of BandWidth Extension (BWE) is well possible to be used. The BWE concept sometimes is also called High Band Extension (HBE) or SubBand Replica (SBR). BWE usually comprises frequency envelope coding, temporal envelope coding, and spectral fine structure generation. The corresponding signal in time domain of fine spectral structure with its spectral envelope removed is usually called excitation. For low bit rate encoding/decoding algorithms including BWE, the most critical problem is to encode fast changing signals, which sometimes require special or different algorithm to increase the efficiency. Unavoidable errors in generating the fine spectrum could lead to an unstable decoded signal or obviously audible echoes especially for energy attack signal. Fine or precise quantization of temporal envelope shape for energy attack signal can clearly reduce echoes; but could require lot of bits if a traditional approach is used. A well known BWE can be found in the standard ITU-T G.729.1 in which the algorithm is named as Time Domain Bandwidth Extension (TDBWE).

Frequency domain is defined to be in the FFT transformed domain. It can also be in the Modified Discrete Cosine Transform (MDCT) domain.

General Description of ITU-T G.729.1

ITU-T G.729.1 is also called a G.729EV coder, which is an 8-32 kbit/s scalable wideband (50 Hz-7,000 Hz) extension of ITU-T Rec. G.729. By default, the encoder input and decoder output are sampled at 16,000 Hz. The bitstream produced by the encoder is scalable and consists of 12 embedded layers, which will be referred to as Layers 1 to 12. Layer 1 is the core layer corresponding to a bit rate of 8 kbit/s. This layer is compliant with G.729 bitstream, which makes G.729EV interoperable with G.729. Layer 2 is a narrowband enhancement layer adding 4 kbit/s, while Layers 3 to 12 are wideband enhancement layers adding 20 kbit/s with steps of 2 kbit/s.

The G.729EV coder is designed to operate with a digital signal sampled at 16,000 Hz followed by a conversion to 16-bit linear PCM before the converted signal is inputted to the encoder. However, the 8,000 Hz input sampling frequency is also supported. Similarly, the format of the decoder output is 16-bit linear PCM with a sampling frequency of 8,000 or 16,000 Hz. Other input/output characteristics should be converted to 16-bit linear PCM with 8,000 or 16,000 Hz sampling before encoding, or from 16-bit linear PCM to the appropriate format after decoding.

The G.729EV coder is built upon a three-stage structure: embedded Code-Excited Linear-Prediction (CELP) coding, Time-Domain Bandwidth Extension (TDBWE), and predictive transform coding that is also referred to as Time-Domain Aliasing Cancellation (TDAC). The embedded CELP stage generates Layers 1 and 2, which yield a narrowband synthesis (50 Hz-4,000 Hz) at 8 kbit/s and 12 kbit/s. The TDBWE stage generates Layer 3 and allows producing a wideband output (50 Hz-7,000 Hz) at 14 kbit/s. The TDAC stage operates in the MDCT domain and generates Layers 4 to 12 to improve quality from 14 kbit/s to 32 kbit/s. TDAC coding represents the weighted CELP coding error signal in the 50 Hz-4,000 Hz band and the input signal in the 4,000 Hz-7,000 Hz band.

The G.729EV coder operates on 20 ms frames. However, the embedded CELP coding stage operates on 10 ms frames, such as G.729 frames. As a result, two 10 ms CELP frames are processed per 20 ms frame. In the following, to be consistent with the context of ITU-T Rec. G.729, the 20 ms frames used by G.729EV will be referred to as superframes, whereas the 10 ms frames and the 5 ms subframes involved in the CELP processing will be called frames and subframes, respectively.

G.729.1 Encoder

A functional diagram of the encoder part is presented in FIG. 1. The encoder operates on 20 ms input superframes. By default, the input signal 101, $s_{WB}(n)$, is sampled at 16,000 Hz. Therefore, the input superframes are 320 samples long. The input signal $s_{WB}(n)$ is first split into two sub-bands using a QMF filter bank defined by filters $H_1(z)$ and $H_2(z)$. The lower-band input signal 102, $s_{LB}^{qmf}(n)$, obtained after decimation is pre-processed by a high-pass filter $H_{h1}(Z)$ with a 50 Hz cut-off frequency. The resulting signal 103, $s_{LB}(n)$, is coded by the 8-12 kbit/s narrowband embedded CELP encoder. To be consistent with ITU-T Rec. G.729, the signal $s_{LB}(n)$ will also be denoted as s(n). The difference 104, $d_{LB}(n)$ between s(n) and the local synthesis 105, $\hat{s}_{enh}(n)$ of the CELP encoder at 12 kbit/s is processed by the perceptual weighting filter $W_{LB}(z)$. The parameters of $W_{LB}(z)$ are derived from the quantized LP coefficients of the CELP encoder. Furthermore, the filter $W_{LB}(z)$ includes a gain compensation which guarantees the spectral continuity between the output 106, $d_{LB}^{w}(n)$, of $W_{LB}(z)$ and the higher-band input signal 107, $s_{HB}(n)$. The weighted difference $d_{LB}^{w}(n)$ is then transformed into frequency domain by MDCT. The higher-band input signal 108, $s_{HB}^{fold}(n)$, which is obtained after decimation and spectral folding by $(-1)^n$, is pre-processed by a low-pass filter $H_{h2}(z)$ with a 3,000 Hz cut-off frequency. The resulting signal $s_{HB}(n)$ is coded by the TDBWE encoder. The signal $s_{HB}(n)$ is also transformed into frequency domain by MDCT. The two sets of MDCT coefficients, 109, $D_{LB}^{w}(k)$, and 110, $S_{HB}(k)$, are finally coded by the TDAC encoder. In addition, some parameters are transmitted by the frame erasure concealment (FEC) encoder in order to introduce parameter-level redundancy in the bitstream. This redundancy results in an improved quality in the presence of erased superframes.

TDBWE Encoder

The TDBWE encoder is illustrated in FIG. 2. The Time Domain Bandwidth Extension (TDBWE) encoder extracts a fairly coarse parametric description from the pre-processed and downsampled higher-band signal 201, $s_{HB}(n)$. This parametric description comprises time envelope 202 and frequency envelope 203 parameters. A summarized description of respective envelope computations and the parameter quantization scheme will be given later.

The 20 ms input speech superframe 201, $s_{HB}(n)$, is subdivided into 16 segments of length 1.25 ms each, i.e., each segment comprises 10 samples. The 16 time envelope parameters 202, $T_{env}(i)$, i=0, . . . , 15, are computed as logarithmic subframe energies:

$$T_{env}(i) = \frac{1}{2}\log_2\left(1/10\sum_{n=0}^{9} S_{HB}^2(n+i\cdot 10)\right),\ i=0,\ldots,15 \tag{1}$$

The TDBWE parameters $T_{env}(i)$, i=0, . . . , 15, are quantized by mean-removed split vector quantization. First, a mean time envelope 204 is calculated:

$$M_T = \frac{1}{16}\sum_{i=0}^{15} T_{env}(i) \tag{2}$$

The mean value 204, $M_T$, is then scalar quantized with 5 bits using uniform 3 dB steps in log domain. This quantization gives the quantized value 205, $\hat{M}_T$. The quantized mean is then subtracted:

$$T_{env}^{M}(i)=T_{env}(i)-\hat{M}_T, i=0, \ldots, 15 \tag{3}$$

The mean-removed time envelope parameter set is split into two vectors of dimension 8

$$T_{env,1}=(T_{env}^{M}(0), T_{env}^{M}(1)_1, \ldots, T_{env}^{M}(7)) \text{ and } T_{env,2}=(T_{env}^{M}(8), T_{env}^{M}(9), \ldots, T_{env}^{M}(15)) \tag{4}$$

Finally, a vector quantization using pre-trained quantization tables is applied. Note that the vectors $T_{env,1}$ and $T_{env,2}$ share the same vector quantization codebooks to reduce storage requirements. The codebooks (or quantization tables) for $T_{env,1}/T_{env,2}$ have been generated by modifying generalized Lloyd-Max centroids such that a minimal distance between two centroids is verified. The codebook modification procedure consists of rounding Lloyd-Max centroids on a rectangular grid with a step size of 6 dB in log domain.

For the computation of the 12 frequency envelope parameters 203, $F_{env}(j)$, j=0, . . . , 11, the signal 201, $s_{HB}(n)$, is windowed by a slightly asymmetric analysis window $w_F(n)$. The maximum of the window $w_F(n)$ is centered on the second 10 ms frame of the current superframe. The window $w_F(n)$ is constructed such that the frequency envelope computation has a lookahead of 16 samples (2 ms) and a lookback of 32 samples (4 ms). The windowed signal $s_{HB}^{w}(n)$ is transformed by FFT. Finally, the frequency envelope parameter set is calculated as logarithmic weighted sub-band energies for 12 evenly spaced and equally wide overlapping sub-bands in the FFT domain. The j-th sub-band starts at the FFT bin of index 2*j* and spans a bandwidth of 3 FFT bins.

G729.1 Decoder

A functional diagram of the decoder is presented in FIG. 3. The specific case of frame erasure that concealment is not considered in this figure. The decoding depends on the actual number of received layers or equivalently on the received bit rate.

If the received bit rate is:

8 kbit/s (Layer 1): The core layer is decoded by the embedded CELP decoder to obtain 301, $\hat{s}_{LB}(n)=\hat{s}(n)$. $\hat{s}_{LB}(n)$ is then post-filtered into 302, $\hat{s}_{LB}^{post}(n)$, and post-processed by a high-pass filter (HPF) into 303, $\hat{s}_{LB}^{qmf}(n)=\hat{s}_{LB}^{hpf}(n)$. The QMF synthesis filterbank defined by the filters $G_1(z)$ and $G_2(z)$ generates the output with a high-frequency synthesis 304, $\hat{s}_{HB}^{qmf}(n)$, set to zero.

12 kbit/s (Layers 1 and 2): The core layer and narrowband enhancement layer are decoded by the embedded CELP decoder to obtain 301, $\hat{s}_{LB}(n)=\hat{s}_{enh}(n)$. $\hat{s}_{LB}(n)$ is then postfiltered into 302, $\hat{s}_{LB}^{post}(n)$ and high-pass filtered to obtain 303, $\hat{s}_{LB}^{qmf}(n)=\hat{s}_{LB}^{hpf}(n)$. The QMF synthesis filterbank generates the output with a high-frequency synthesis 304, $\hat{s}_{HB}^{qmf}(n)$ set to zero.

14 kbit/s (Layers 1 to 3): In addition to the narrowband CELP decoding and lower-band adaptive post-filtering, the TDBWE decoder produces a high-frequency synthesis 305, $\hat{s}_{HB}^{bwe}(n)$ which is then transformed into frequency domain by MDCT so as to zero the frequency band above 3000 Hz in the higher-band spectrum 306, $\hat{s}_{HB}^{bwe}(k)$. The resulting spectrum 307, $\hat{s}_{HB}(k)$ is transformed in time domain by inverse MDCT and overlap-added before spectral folding by $(-1)^n$. In the QMF synthesis filter-bank the reconstructed higher band signal 304, $\hat{s}_{HB}^{qmf}(n)$ is combined with the respective lower band signal 302, $\hat{s}_{LB}^{qmf}(n)=\hat{s}_{LB}^{post}(n)$, and is reconstructed at 12 kbit/s without high-pass filtering.

Above 14 kbit/s (Layers 1 to 4+): In addition to the narrowband CELP and TDBWE decoding, the TDAC decoder reconstructs MDCT coefficients 308, $\hat{D}_{LB}^{w}(k)$ and 307, $\hat{S}_{HB}(k)$, which correspond to the reconstructed weighted difference in lower band (0-4000 Hz) and the reconstructed signal in higher band (4000-7000 Hz). Note that in the higher band, the non-received sub-bands and the sub-bands with zero bit allocation in TDAC decoding are replaced by the level-adjusted sub-bands of $\hat{S}_{HB}^{bwe}(k)$. Both $\hat{D}_{LB}^{w}(k)$ and $\hat{S}_{HB}(k)$ are transformed into time domain by inverse MDCT and overlap-add. The lower-band signal 309, $\hat{d}_{LB}^{w}(n)$, is then processed by the inverse perceptual weighting filter $W_{LB}(z)^{-1}$. To attenuate transform coding artifacts, pre/post-echoes are detected and reduced in both the lower-band and higher-band signals 310, $\hat{d}_{LB}(n)$ and 311, $\hat{s}_{HB}(n)$. The lower-band synthesis $\hat{s}_{LB}(n)$ is post-filtered, while the higher-band synthesis 312, $\hat{s}_{HB}^{fold}(n)$, is spectrally folded by $(-1)^n$. The signals $\hat{s}_{LB}^{qmf}(n)=\hat{s}_{LB}^{post}(n)$ and $\hat{s}_{HB}^{qmf}(n)$ are then combined and upsampled in the QMF synthesis filterbank.

TDBWE Decoder

FIG. 4 illustrates the concept of the TDBWE decoder module. The TDBWE receives parameters that are used to shape an artificially generated excitation signal 402, $\hat{s}_{HB}^{exc}(n)$, according to desired time and frequency envelopes 408, $\hat{T}_{env}(i)$, and 409, $\hat{F}_{env}(j)$. This is followed by a time-domain post-processing procedure.

The quantized parameter set consists of the value $\hat{M}_T$ and of the following vectors: $\hat{T}_{env,1}$, $\hat{T}_{env,2}$, $\hat{F}_{env,1}$, $\hat{F}_{env,2}$ and $\hat{F}_{env,3}$. The split vectors are defined by Equations 4. The quantized mean time envelope $\hat{M}_T$ is used to reconstruct the time envelope and the frequency envelope parameters from the individual vector components, i.e.:

$$\hat{T}_{env}(i)=\hat{T}_{env}^{M}(i)+\hat{M}_T, i=0, \ldots, 15 \tag{5}$$

and $$\hat{F}_{env}(j)=\hat{F}_{env}^{M}(j)+\hat{M}_T, j=0, \ldots, 11 \tag{6}$$

The TDBWE excitation signal 401, exc(n), is generated by 5 ms subframe based on parameters that are transmitted in Layers 1 and 2 of the bitstream. Specifically, the following parameters are used: the integer pitch lag $T_0=\text{int}(T_1)$ or int $(T_2)$ depending on the subframe, the fractional pitch lag frac, the energy of the fixed codebook contributions, which is expressed as $$E_c = \sum_{n=0}^{39} (\hat{g}_c \cdot c(n) + \hat{g}_{enh} \cdot c'(n))^2,$$

and the energy of the adaptive codebook contribution, which is expressed as $$E_p = \sum_{n=0}^{39} (\hat{g}_p \cdot v(n))^2.$$

The parameters of the excitation generation are computed every 5 ms subframe. The excitation signal generation consists of the following steps:

Estimation of two gains $g_v$ and $g_{uv}$ for the voiced and unvoiced contributions to the final excitation signal 401, exc (n);

pitch lag post-processing;

generation of the voiced contribution;

generation of the unvoiced contribution; and low-pass filtering.

The shaping of the time envelope of the excitation signal 402, $s_{HB}^{exc}(n)$, utilizes the decoded time envelope parameters 408, $\hat{T}_{env}(i)$, with i=0, . . . , 15 to obtain a signal 403, $\hat{s}_{HB}^{T}(n)$ with a time envelope that is near-identical to the time envelope of the encoder side higher-band signal 201, $s_{HB}(n)$. This is achieved by simple scalar multiplication:

$$\hat{s}_{HB}^{T}(n)=g_T(n)\cdot s_{HB}^{exc}(n), n=0, \ldots, 159 \tag{7}$$

In order to determine the gain function $g_T(n)$, the excitation signal 402, $\hat{s}_{HB}^{exc}(n)$, is segmented and analyzed in the same manner as the parameter extraction in the encoder. The obtained analysis results are, again, time envelope parameters $\tilde{T}_{env}(i)$ with i=0, . . . , 15. They describe the observed time envelope of $s_{HB}^{exc}(n)$. Then a preliminary gain factor is calculated:

$$g'_T(i)=2^{\hat{T}_{env}(i)-\tilde{T}_{env}(i)}, i=0, \ldots, 15 \tag{8}$$

For each signal segment with index i=0, . . . , 15, these gain factors are interpolated using a "flat-top" Hanning window $$w_t(n)=\begin{cases} \frac{1}{2}\cdot\left[1-\cos\left((n+1)\cdot\frac{\pi}{6}\right)\right] & n=0, \ldots, 4 \\ 1 & n=5, \ldots, 9 \\ \frac{1}{2}\cdot\left[1-\cos\left((n+9)\cdot\frac{\pi}{6}\right)\right] & n=10, \ldots, 14 \end{cases} \tag{9}$$

This interpolation procedure finally yields the desired gain function:

$$g_T(n+i\cdot 10)=\begin{cases} w_t(n)\cdot g'_T(i)+w_t(n+10)\cdot g'_T(i-1) & n=0, \ldots, 4 \\ w_t(n)\cdot g'_T(i) & n=5, \ldots, 9 \end{cases} \tag{10}$$

wherein $g'_T(-1)$ is defined as the memorized gain factor $g'_T$ (15) from the last 1.25 ms segment of the preceding superframe.

The signal 404, $\hat{s}_{HB}^{F}(n)$, was obtained by shaping the excitation signal $s_{HB}^{exc}(n)$ (generated from parameters estimated in lower-band by the CELP decoder) according to the desired time and frequency envelopes. There is in general no coupling between this excitation and the related envelope shapes $\hat{T}_{env}(i)$ and $\hat{F}_{env}(j)$. As a result, some clicks may be present in the signal $\hat{s}_{HB}^{F}(n)$. To attenuate these artifacts, an adaptive amplitude compression is applied to $\hat{s}_{HB}^{F}(n)$. Each sample of $\hat{s}_{HB}^{F}(n)$ of the i-th 1.25 ms segment is compared to the decoded time envelope $\hat{T}_{env}(i)$ and the amplitude of $\hat{s}_{HB}^{F}(n)$ is compressed in order to attenuate large deviations from this envelope. The TDBWE synthesis 405, $\hat{s}_{HB}^{bwe}(n)$, is transformed to $\hat{S}_{HB}^{bwe}(k)$ by MDCT. This spectrum is used by the TDAC decoder to extrapolate missing sub-bands.

SUMMARY OF THE INVENTION

In one embodiment, the present invention provides a method of quantizing the temporal envelope of an energy attack signal. The existence of energy attack signal is detected and a decision flag is sent to a decoder. The location of the energy attack point is detected and sent to the decoder. Peak area energy, energy variations before the attack point, and energy variations after the attack point are all quantized. All the quantization indices are sent to the decoder to rebuild the temporal envelope shape of energy attack signal.

In one example, the detection of the existence of energy attack signal is based on one or more ratios between the peak magnitude and the average magnitudes, a ratio between two magnitudes of adjacent small segments, and/or the pitch correlation. The parameter of pitch correlation can be replaced by pitch gain or other voicing parameter, which can represent the signal periodicity.

In one example, the detection of the energy attack point location is based on searching for the maximum energy area and/or the maximum energy increasing area from one small segment to next segment.

In one example, the energy variations before the attack point can be shaped by doing interpolation between the beginning level of the segment and the ending level of the segment.

In one example, the energy variations after the peak area can be shaped by doing interpolation between the beginning level of the segment and the ending level of the segment.

In one example, it is assumed that signal energy after the peak area will decay or decrease.

In another embodiment, a method of quantizing the temporal envelope of the energy attack signal includes detecting the existence of the energy attack signal and sending a decision flag to decoder. The location of energy attack point is detected and sent to the decoder. The peak area energy, the average energy before the attack point, and the average energy after the attack point are quantized. Quantization indices are sent to the decoder to rebuild the temporal envelope shape of the energy attack signal.

In another embodiment of quantizing the temporal envelope of the energy attack signal, the existence of the energy attack signal is detected and a decision flag is sent to a decoder. The location of energy attack point is detected and sent to the decoder. The peak area energy, the average energy before the attack point, and the energy variations after the attack point are quantized. All the quantization indices are sent to the decoder to rebuild the temporal envelope shape of the energy attack signal.

In another embodiment, a method of quantizing the temporal envelope of the energy attack signal is disclosed. The existence of the energy attack signal is detected and a decision flag is sent to a decoder. The location of energy attack point is detected and sent to the decoder. The peak area energy is quantized and the indices are sent to the decoder to improve the temporal envelope shape of the energy attack signal.

In yet another embodiment, a method of quantizing the temporal envelope of the energy attack signal includes detecting the existence of energy attack signal and sending the decision flag to a decoder. The location of the energy attack point is detected and sent to the decoder. The temporal envelope shape of the energy attack signal at decoder side is improved by making use of the received energy attack point location.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF ILLUSTRATIVE EMBODIMENTS

Figure 1:
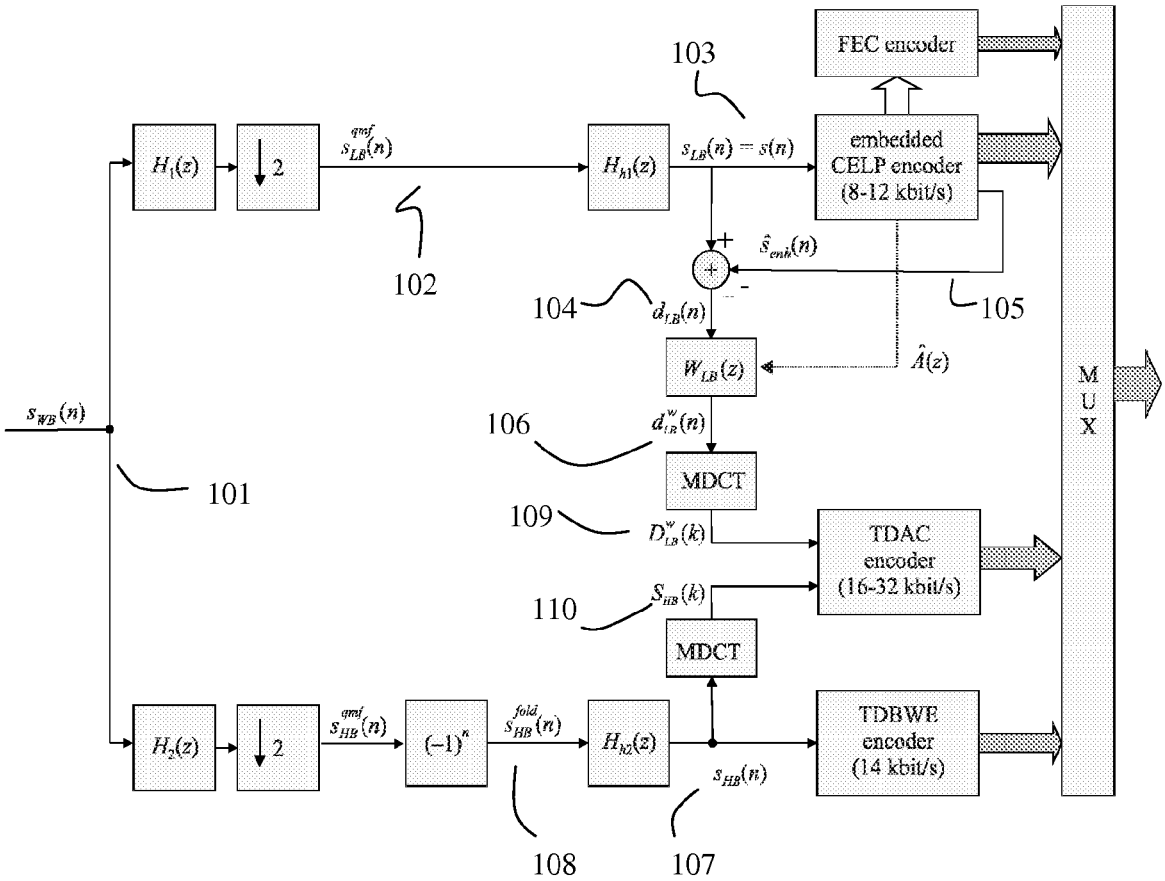
FIG. 1 Prior Art
FIG. 1 illustrates a high-level block diagram of the G.729.1 encoder.
Figure 2:
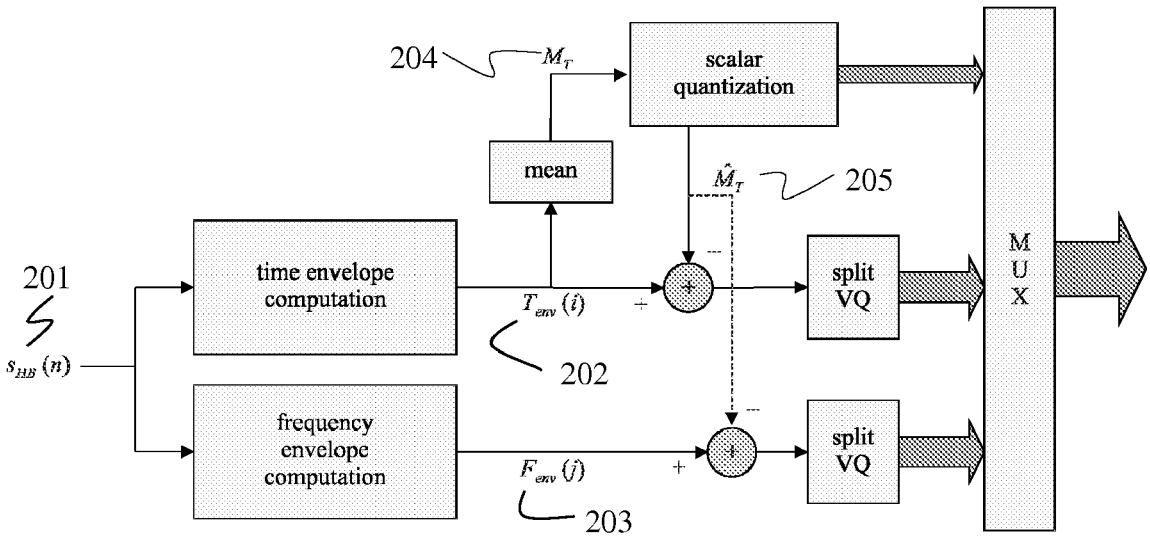
FIG. 2 Prior Art
FIG. 2 illustrates a high-level block diagram of the TDBWE encoder for G.729.1.
Figure 3:
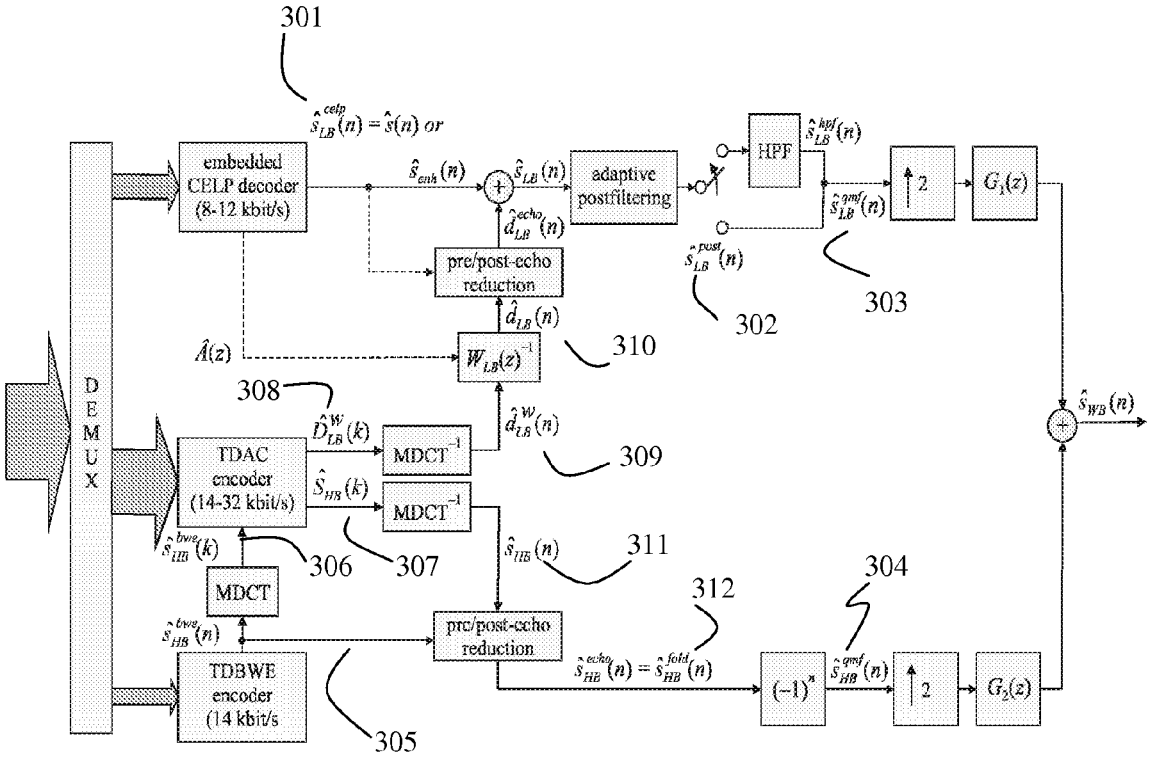
FIG. 3 Prior Art
FIG. 3 illustrates a high-level block diagram of the G.729.1 decoder.
Figure 4:
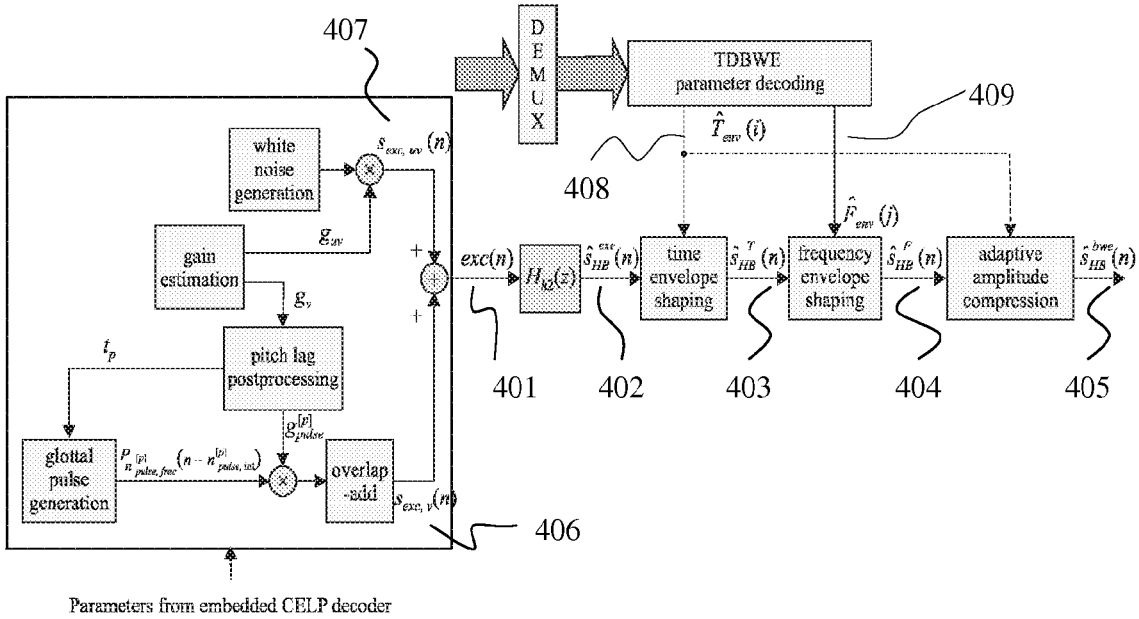
FIG. 4 Prior Art
FIG. 4 illustrates a high-level block diagram of the TDBWE decoder for G.729.1.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

For low bit rate transform encoding/decoding algorithms including BWE, the most critical problem is to encode fast changing signals, which sometimes require special or different algorithms to increase the coding efficiency. A typical fast changing signal is an energy attack signal, which is also called a transient signal. Unavoidable errors in generating or decoding fine spectrum at very low bit rate can lead to an unstable decoded signal or obviously audible echoes especially for energy attack signal. Pre-echo is audible especially in regions before energy attack point. One of the approaches to suppress echoes is to introduce quantization of temporal envelope shaping and send it to decoder. The usual quantization approach of temporal envelope shaping lacks efficiency. Embodiments of the present invention use more efficient ways to quantize temporal envelope shaping for energy attack signals by sending energy attack point location, peak area energy, average energies before/after the peak area, and/or some energy variations to the decoder. Energy interpolation is also possibly used in embodiments of the present invention.

Frequency domain coding (transform coding) has been widely used in various ITU-T, MPEG, and 3 GPP standards. If bit rate is high enough, spectral subbands are often coded with some kinds of vector quantization (VQ) approaches. If bit rate is very low, a concept of BandWidth Extension (BWE) can be used. The BWE concept sometimes is also called High Band Extension (HBE) or SubBand Replica (SBR). Although the name could be different, they all have the similar meaning of encoding/decoding some frequency sub-bands (usually high bands) with little budget of bit rate or significantly lower bit rate than normal encoding/decoding approach.

BWE often encodes and decodes some perceptually critical information within a bit budget while generating some information with very limited bit budget or without spending any number of bits. BWE usually comprises frequency envelope coding, temporal envelope coding (optional), and spectral fine structure generation. A precise description of spectral fine structure needs a lot of bits, which may be unrealistic for BWE algorithms. A realistic way is to artificially generate spectral fine structure, which means that spectral fine structure could be copied from other bands or mathematically generated according to limited available parameters. The corresponding signal in time domain of fine spectral structure with its spectral envelope removed is usually called excitation. For low bit rate transform encoding/decoding algorithms including BWE, the most critical problem is to encode fast changing signals, which sometimes require special or different algorithm to increase the efficiency.

A typical fast changing signal is an energy attack signal, which is also called a transient signal. Unavoidable errors in generating or decoding fine spectrum at very low bit rate can lead to unstable decoded signal or obviously audible echoes especially for the energy attack signal. Pre-echo and post-echo are typical artifacts in low-bit-rate transform coding. Pre-echo is audible especially in regions before energy attack point (preceding sharp transient), such as clean speech onsets or percussive sound attacks (e.g. castanets). Indeed, pre-echo is coding noise that is injected in transform domain but is spread in time domain over the synthesis window by the transform decoder.

For an energy attack signal (a transient) with a sharp energy increase, the low-energy region of the input signal before the energy attack point (preceding the transient) is therefore mixed with noise or unstable energy variation, and the signal to noise ratio (in dB) is often negative in such low-energy parts. A similar artifact, post-echo, exists after a sudden signal offsets. However, post-echo is usually less a problem due to post-masking properties. Also, in real sounds recordings a sudden signal offset is rarely observed due to reverberation. Technically, the name echo is referred to as pre-echo and post-echo generated by transform coding.

Many methods may be used to solve the problem of echo in transform audio coding, especially for the case of modified discrete cosine transform (MDCT) coding. One approach is to make the filter-bank signal adaptive, using window switching controlled by transient detection. Usually, window switching implies extra delay and complexity compared with using a non-adaptive filter-bank. Furthermore, short windows may result in lower transform coding gains than long windows, and side information needs to be sent to the decoder to indicate the switching decision. A similar idea (in the frequency domain) is to use adaptive subband decomposition via biorthogonal lapped transform. Another approach consists of performing temporal noise shaping (TNS). Note that TNS requires the transmission of noise shaping filter coefficients as side information. Other methods may also be considered, e.g. transient modification prior to transform coding or synthesis window switching controlled by transient detection at the decoder.

One efficient approach to suppress pre-echo and post-echo is to perform temporal envelope shaping, which has been used in TDBWE algorithm of ITU-T G.729.1. Fine or precise quantization of the temporal envelope for energy attack signal may require lot of bits. TDBWE needs a lot of bits to encode temporal envelope, but may not be able to precisely describe the temporal envelope for energy attack signal. Some embodiments of this invention detect the energy attack signal, find the energy attack point, and introduce a specific approach to encode the temporal envelope more efficiently by making use of the energy attack point location. The proposed approach can be combined with other approach to further improve the efficiency.

The TDBWE example employed in G.729.1 works at the sampling rate of 16,000 Hz. The following proposed approach, although using 16,000 Hz as an example, will not be limited to the sampling rate of 16,000 Hz. It may also work at the sampling rate of 32,000 Hz or any other sampling rate. For simplicity, the following simplified notations generally mean the same concept for any sampling rate. Suppose one frame is divided into many small segments (sub-segments) in time domain as described in ITU-T G.729.1. Temporal envelope shaping is made of plurality of magnitudes. Each magnitude represents square root of average energy of each sub-segment in Linear domain or Log domain as described in G729.1. In other words, the energy or magnitude of each small signal segment represents the temporal envelope.

Unquantized temporal envelope shaping for one frame in encoder is noted as:

$$T_{env}(i), i=0,1,2,\ldots,N_{env}-1 \tag{11}$$

wherein $N_{env}$, is the number of small segments. The duration of each sub-segment size depends on real application and can be as short as 1.25 ms. As already mentioned, BWE algorithm usually comprises spectral envelope coding, temporal envelope coding, and spectral fine structure generation (excitation generation). Any low bit rate coding can also include temporal envelope coding. The embodiments are related to temporal envelope coding. In particular, it aims to improve the temporal envelope coding of energy attack signal. The typical energy attack signal is castanet music signal. Energy attack also exists in any other music signals, although it also occasionally appears in speech signals.

Figure 5:
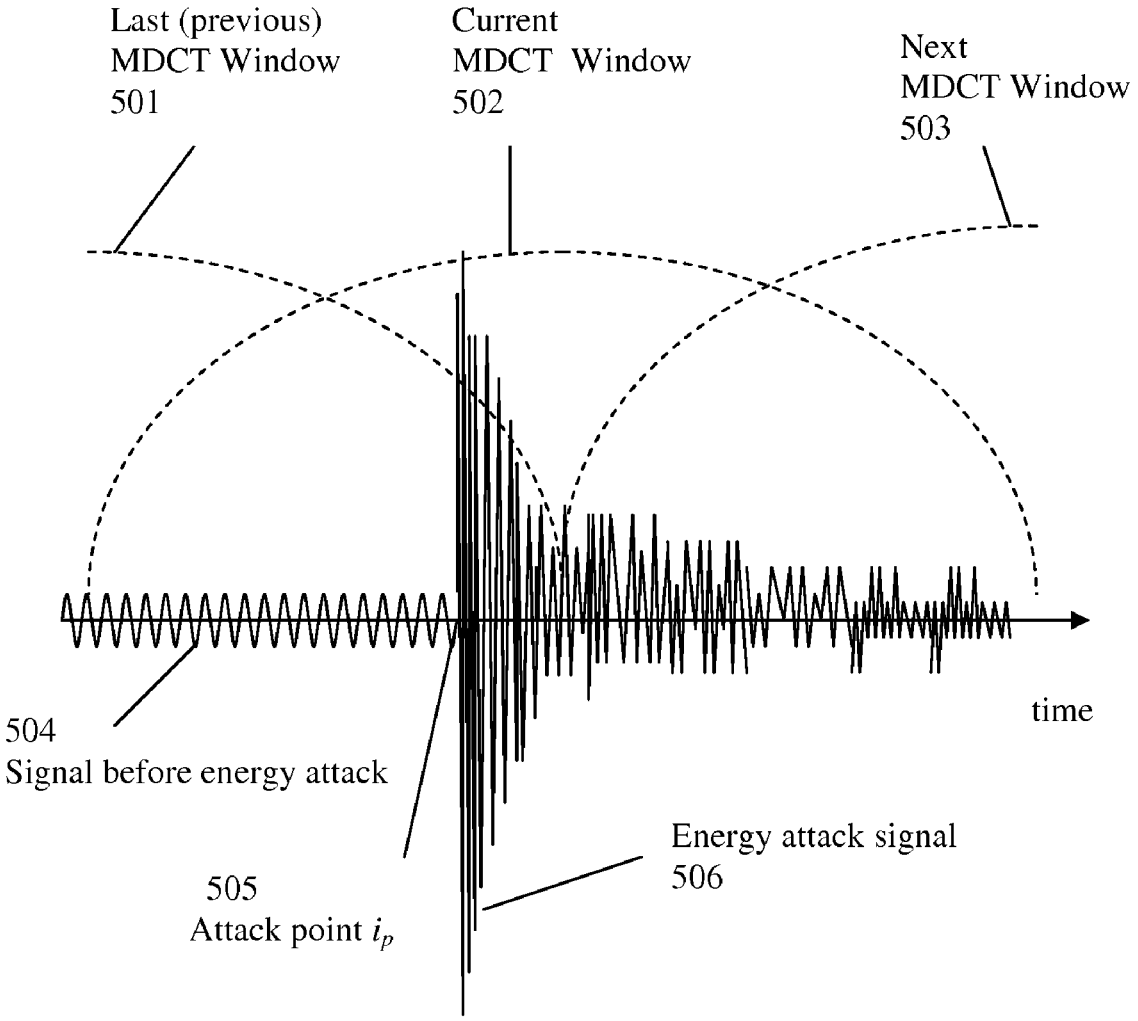
FIG. 5 illustrates an example of original energy attack signal in time domain.

FIG. 5 shows a typical energy attack signal in time domain. As shown in the figure, before the energy attack point 505, the signal energy 504 is relatively low and the signal energy is stable. Just after the energy attack point, the signal energy 506 suddenly increases significantly, and the spectrum could also dramatically change. MDCT transformation is performed on a windowed signal. Two adjacent windows are overlapped each other. The window size could be as large as 40 ms with 20 ms overlapped in order to increase the efficiency of MDCT-based audio coding algorithm. 501 shows previous MDCT window, wherein 502 indicates current MDCT window, and 503 is the next MDCT window.

Figure 6:
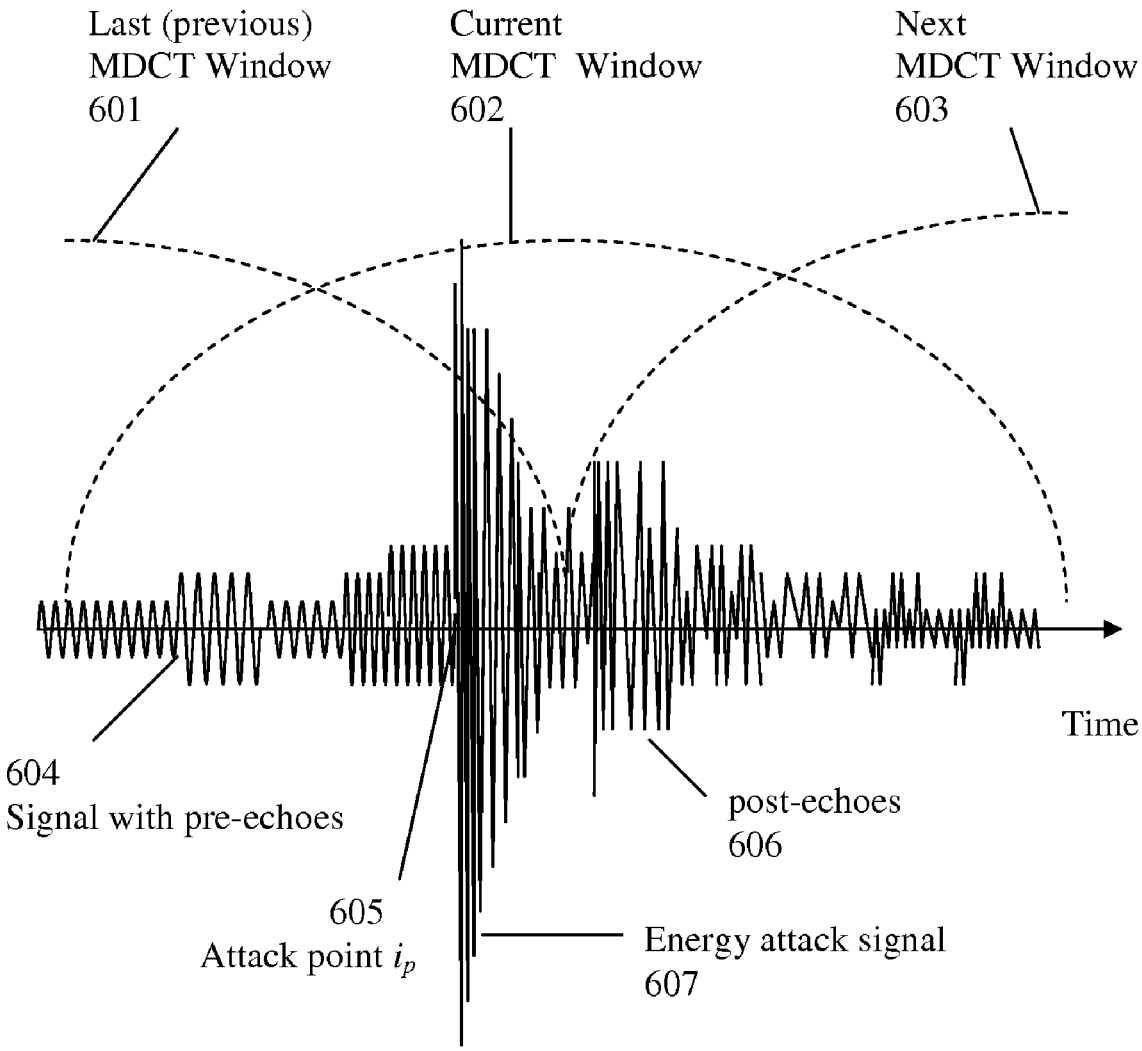
FIG. 6 illustrates an example of decoded energy attack signal with pre-echoes.

For an energy attack signal, one window or one frame could cover two totally different segments of signals, causing difficult temporal envelope coding with traditional scalar quantization (SQ) or vector quantization (VQ). Precise SQ and VQ of the temporal envelope for energy attack signal requires quite lot of bits, and a rough quantization of the temporal envelope for energy attack signal could result in undesired remaining pre-echoes as shown in FIG. 6, where 601 shows previous MDCT window, 602 indicates current MDCT window, and 603 is the next MDCT window. 604 is the signal with pre-echo before the attack point 605. 607 is energy attack signal after the attack point. 606 shows the signal with post-echo.

Figure 7:
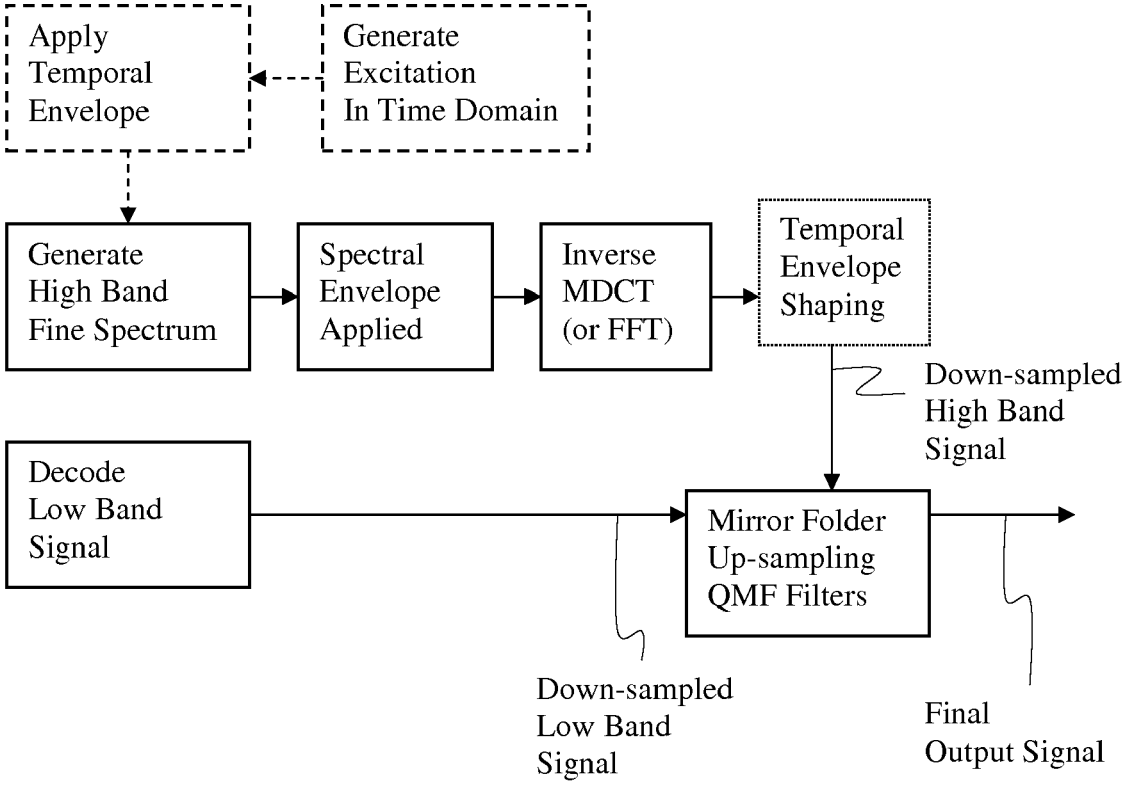
FIG. 7 illustrates an example of basic principle of audio decoding with BWE.

FIG. 7 shows a typical example of audio decoder principle using BWE for high band. Although temporal envelope coding is often used for BWE-based high band coding, it can be also used for low band coding to reduce echoes. In FIG. 7, the temporal envelope shaping can be placed after applying spectral envelope or simply performed during time domain excitation generation before applying spectral envelope.

An embodiment method of temporal envelope coding for an energy attack has the steps described now:

Detecting energy attack signal. Since the special approach is only used for energy attack signal, the detection of energy attack signal frame may be made first. 1 bit/frame can be sent to decoder to indicate the existence of energy attack signal. The detection of the existence of energy attack signal is based on one or more ratios between peak magnitude and average magnitudes, a ratio between two magnitudes of adjacent small segments, and/or pitch correlation. The parameter of pitch correlation can be replaced by pitch gain or other voicing parameter, which can represent the signal periodicity. One of the following parameters or a combination of the following parameters can be explored to do the detection of energy attack signal frame:

(1) The ratio of peak magnitude (energy) to average frame magnitude (energy), $$P_1 = \frac{\mathrm{Max}\{T_{env}(i),\ i=0,1,\ldots\}}{\left(\frac{1}{N_{env}}\right)\sum_i T_{env}(i)} \tag{12}$$

One frame of time domain signal is divided into many small segments such as finding the maximum magnitude among those small segments; and calculating the average magnitude of those small segments. If the peak magnitude is very large relatively to the average magnitude, there is a good chance that the energy attack exists. A variant expression of $P_1$ could be:

$$P_1 = \frac{\mathrm{Max}\{T_{env}(i),\ i=0,1,\ldots\}}{\left(\frac{1}{N_{env}}\right)\sum_{i\neq peak\ area} T_{env}(i)}$$

where the peak energy area is excluded during the estimate of the average energy (or average magnitude).

(2) The ratio of peak magnitude (energy) to average frame magnitude (energy) before energy attack point may be expressed as:

$$P_2 = \frac{\mathrm{Max}\{T_{env}(i),\ i=0,1,\ldots\}}{\left(\frac{1}{i_p}\right)\sum_{i<i_p} T_{env}(i)}, \tag{13}$$

which finds the maximum magnitude among those small segments and record the location of peak energy; calculate the average magnitude of those small segments before the peak location. If the peak magnitude is very large with relative to the average magnitude before the peak location, there is a good chance that the energy attack exists.

(3) The energy ratio between two adjacent small segments may be expressed as:

$$P_3 = \mathrm{Max}\left\{\frac{T_{env}(i+1)}{T_{env}(i)},\ i=0,1,2,\ldots\right\}, \tag{14}$$

which finds the largest energy ratio of two adjacent small segments in the frame. If this ratio is very large, there is a good chance that the energy attack exists.

(4) The ratio of the peak magnitude (energy) to the average frame magnitude, excluding the peak energy area may be expressed as: |

$$P_4 = \frac{\mathrm{Max}\{T_{env}(i),\ i\neq \text{peak area}\}}{\left(\frac{1}{N_{env}-N_{peak}}\right)\sum_{i\neq peak\ area} T_{env}(i)} \tag{15}$$

find the maximum magnitude among those small segments excluding the peak area; calculate the average magnitude of those small segments also excluding the peak area. This estimated ratio excluding the peak area could tell if there is a second energy attack within one frame. If this ratio is small, it means there is no second energy attack in the frame. Otherwise, there may be other possibilities including that the frame size may not be small enough, that this frame contains no energy attack, or that the frame may only include voiced speech with glottal pulses.

(5) Pitch correlation or pitch gain which may be available from the core layer of CELP may be expressed as:

$$R_p = \frac{\sum_n s(n) \cdot s(n - \text{Pitch})}{\sqrt{\sum_n [s(n)]^2} \cdot \sqrt{\sum_n [s(n - Picth)]^2}} \tag{16}$$

This parameter measures the periodicity of the signal. Normally, energy attack signal does not have high periodicity.

Detecting energy attack point location noted as $i_p$. The detection of energy attack point location is based on searching for maximum energy area and/or maximum energy increasing area from one small segment to next segment. One of the following ways or a combination of the following ways can be used to detect the energy attack point location, including:

(1) searching for the maximum magnitude (energy) among those small segments, $$\text{Max}\{T_{env}(i), i=0,1,2, \ldots, N_{env}-1\} \tag{17}$$

(2) searching for the maximum ratio of two adjacent small segments in the frame using, $$\text{Max}\left\{\frac{T_{env}(i+1)}{T_{env}(i)}, i = 0, 1, 2, \ldots\right\} \tag{18}$$

and sending the energy attack location to decoder, which also defines the energy peak location.

Quantizing the peak energy and send it to decoder. In the decoder, the peak energy will be put in the peak area.

Quantizing the average magnitude (or average energy) of the signal area after the peak energy area (excluding the energy of the peak area); and sending this average energy to decoder. At decoder side, the energy near the peak will be set higher than the average, and the energy near the end of the frame will be set lower than the average. If more bits are available, some variation of the energy envelope in this area can be quantized and sent to decoder to further improve the temporal shape. For example, the beginning and ending levels of the signal segment after the peak area are quantized and then the levels in between the beginning and the ending are interpolated.

Quantizing the average magnitude (or average energy) of the signal area before the energy attack point. At decoder side, this average magnitude (or average energy) will define the energy level of the signal area before the energy attack point. If more bits are available, some variation of the energy envelope in this area can be quantized and sent to decoder to further improve the temporal shape. For example, the beginning and ending levels of the signal segment before the attack point is quantized, and then the levels in between the beginning and the ending are interpolated.

In summary, the energy peak location (or the energy attack point location) and the energy level of the peak area are relevant parameters. If these two parameters are quantized correctly and sent to decoder, a rough estimate of temporal envelope could already be obtained at decoder by assuming that signal energy after the peak area will decay or decrease (as shown in FIG. 5). Additional parameters such as average energies, energy variations (differential energies), and/or energy interpolation parameters can be quantized and sent to decoder to further improve the temporal shape.

Figure 8:
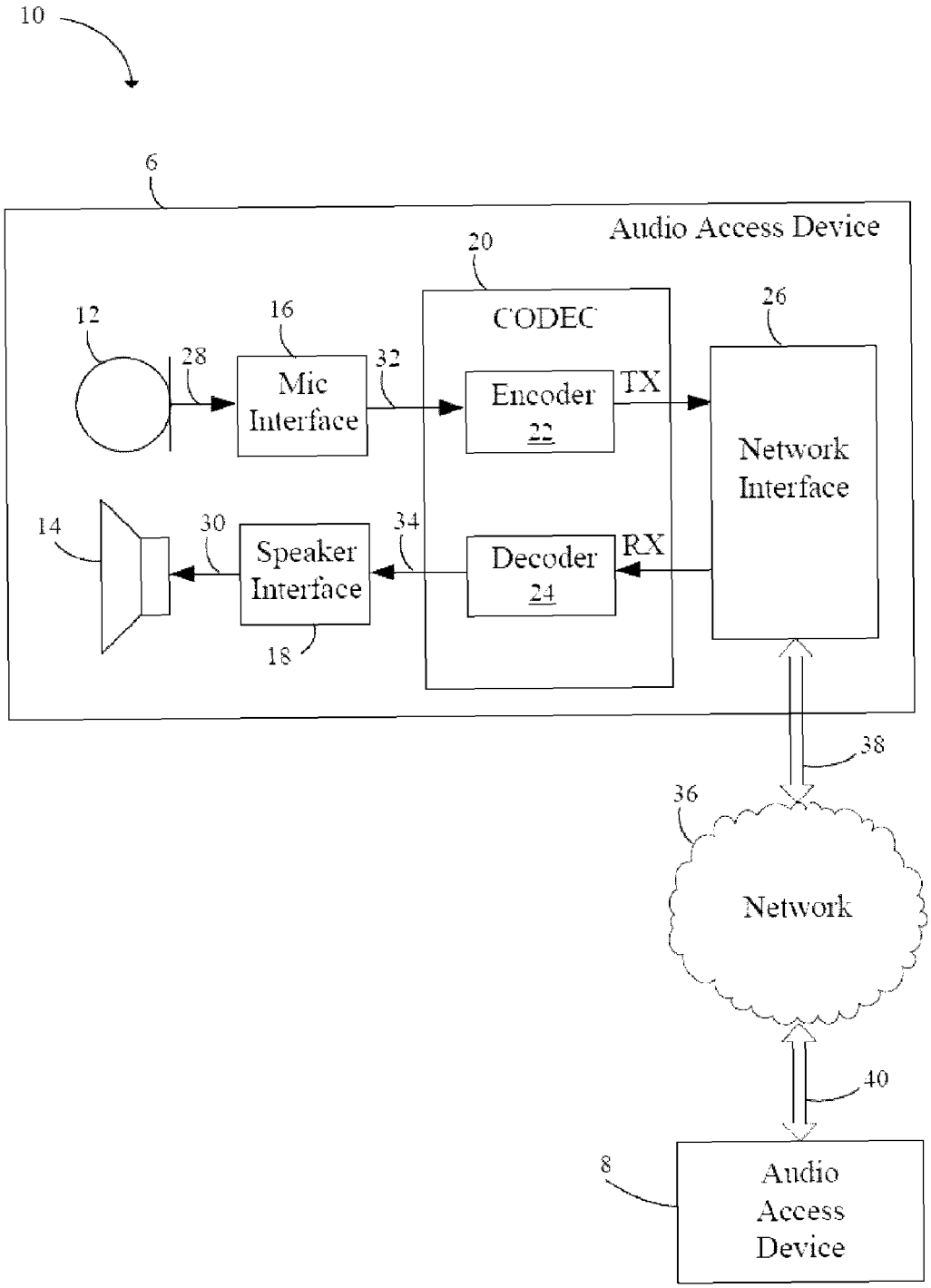
FIG. 8 illustrates a communication system according to an embodiment of the present invention.

FIG. 8 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PTSN) and/or the internet. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In an embodiments of the present invention, where audio access device 6 is a VOIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The above description contains specific information pertaining to quantizing temporal envelope shaping of energy attack signal (also called transient signal). However, one skilled in the art will recognize that the embodiments of the disclosure may be practiced in conjunction with various encoding/decoding algorithms different from those specifically discussed in the present application. Moreover, some of the specific details, which are within the knowledge of a person of ordinary skill in the art, are not discussed to avoid obscuring the concept of the disclosure.

The drawings in the present application and their accompanying detailed description are directed to merely example embodiments of the invention. To maintain brevity, other embodiments of the invention that use the principles of the present invention are not specifically described and are not specifically illustrated by the present drawings.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of transceiving an audio signal, the method comprising:

providing an input audio signal;

determining whether an energy attack signal exists within the input audio signal;

setting a decision flag if the energy attack signal exists;

detecting a temporal location of the energy attack point in the input audio signal;

determining energy variations before and after the temporal location of an energy attack point;

quantizing the energy variations to produce quantized energy variations;

quantizing a peak area energy of the input audio signal to produce a quantized peak area energy; and transmitting the decision flag, the temporal location of the energy attack point, the quantized energy variations and the quantized peak energy.

2. The method of claim 1, further comprising:

determining energy variations before and after the temporal location of an energy attack point;

quantizing the energy variations to produce quantized energy variations;

transmitting the quantized energy variations.

3. The method of claim 1, further comprising:

receiving the transmitted decision flag, temporal location of the energy attack point, and quantized peak energy; and rebuilding a temporal envelope shape of the energy attack signal based on the received decision flag, temporal location of the energy attack point, and quantized peak energy.

4. The method of claim 3, further comprising:

receiving quantized energy variations; and rebuilding a temporal envelope shape of the energy attack signal based on the received decision flag, temporal location of the energy attack point, quantized energy variations and quantized peak energy.

5. The method of claim 3, wherein rebuilding comprises estimating the temporal envelope by assuming that signal energy after the peak area decays.

6. The method of claim 3, further comprising, converting the temporal envelope shape into an output audio signal based on the rebuilding.

7. The method of claim 6, further comprising driving a loudspeaker with the output audio signal.

8. The method of claim 1, wherein transmitting comprises transmitting over a voice over interne protocol (VOIP) network.

9. The method of claim 1, wherein transmitting comprises transmitting over a cellular telephone network.

10. The method of claim 1, wherein determining whether the energy attack signal exists comprises:

determining one or more ratios between a peak magnitude and average magnitudes of the input audio signal; and determining a ratio between two magnitudes of said adjacent small segments within the input audio signal.

11. The method of claim 1, wherein determining whether the energy attack signal exists comprises determining a voicing parameter that represents signal periodicity.

12. The method of claim 1, wherein determining whether the energy attack signal exists comprises determining pitch correlation or pitch gain within the input audio signal.

13. The method of claim 1, wherein determining whether the energy attack signal exists comprises searching for maximum energy area and/or said maximum energy increasing area from one small segment of the input audio signal to a next segment of the input audio signal.

14. The method of claim 1, further comprising shaping energy variations before the temporal location of an energy attack point, shaping comprising interpolating between a beginning level of a segment at the beginning of the frame and an ending level of the segment just before the attack point.

15. The method of claim 1, further comprising shaping energy variations after the temporal location of an energy attack point, shaping comprising interpolating between a beginning level of a segment just after the peak and an ending level of the segment at the end of the frame.

16. The method of claim 1, further comprising:

determining an average energy before the temporal location of an energy attack point;

quantizing the average energy before the temporal location of an energy attack point to produces a quantized average energy;

determining an energy variation after the temporal location of an energy attack point;

quantizing the energy variation after the temporal location of an energy attack point to produces a quantized energy variation; and transmitting the quantized average energy and the quantized energy variation.

17. The method of claim 16, wherein rebuilding further comprising improving the temporal envelope shape based on the received temporal location of the energy attack point, the quantized average energy and the quantized energy variation.

18. The method of claim 1, further comprising:

determining average energies before and after the temporal location of an energy attack point;

quantizing the average energies to produce quantized average energies; and transmitting the quantized average energies.

19. The method of claim 18, further rebuilding further comprising:

improving the temporal envelope shape based on the received temporal location of the energy attack point and the quantized average energies.

* * * * *